US009658576B2

(12) United States Patent
Kimura et al.

(10) Patent No.: US 9,658,576 B2
(45) Date of Patent: May 23, 2017

(54) DEVELOPING DEVICE, AND PROCESS CARTRIDGE AND IMAGE FORMING APPARATUS INCORPORATING SAME

(71) Applicants: Hideki Kimura, Kanagawa (JP); Tadashi Ogawa, Tokyo (JP); Hiroyuki Mabuchi, Kanagawa (JP); Junichi Terai, Kanagawa (JP); Hiroshi Kikuchi, Kanagawa (JP); Yukio Otome, Ibaraki (JP); Hiroaki Okamoto, Kanagawa (JP)

(72) Inventors: Hideki Kimura, Kanagawa (JP); Tadashi Ogawa, Tokyo (JP); Hiroyuki Mabuchi, Kanagawa (JP); Junichi Terai, Kanagawa (JP); Hiroshi Kikuchi, Kanagawa (JP); Yukio Otome, Ibaraki (JP); Hiroaki Okamoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/965,313

(22) Filed: Dec. 10, 2015

(65) Prior Publication Data

US 2016/0170329 A1 Jun. 16, 2016

(30) Foreign Application Priority Data

Dec. 11, 2014 (JP) ..... 2014-250587
Jan. 23, 2015 (JP) ..... 2015-011718
May 27, 2015 (JP) ..... 2015-107289

(51) Int. Cl.
*G03G 15/08* (2006.01)
*G03G 15/09* (2006.01)

(52) U.S. Cl.
CPC ..... *G03G 15/0898* (2013.01); *G03G 15/0881* (2013.01); *G03G 15/0942* (2013.01); *G03G 2215/0648* (2013.01)

(58) Field of Classification Search
CPC ..... G03G 15/0881; G03G 15/0898; G03G 15/0942
See application file for complete search history.

(56) References Cited

U.S. PATENT DOCUMENTS 4,592,653 A * 6/1986 Ikeda ..... G03G 15/0898 399/103
4,792,831 A * 12/1988 Takeda ..... G03G 15/09 399/105

(Continued)

FOREIGN PATENT DOCUMENTS

JP 8-062976 3/1996
JP 2012-226191 11/2012
JP 2013-117563 6/2013

*Primary Examiner* — Ryan Walsh
(74) *Attorney, Agent, or Firm* — Oblon, McClelland, Maier & Neustadt, L.L.P.

(57) ABSTRACT

A developing device includes a developer bearer, a developer regulator, a casing including an opposing face to oppose the developer bearer upstream from a developing range in a direction of rotation of the developer bearer, and first, second, and third seals. The first seal includes a first end secured to the casing and a second end to contact a latent image bearer upstream from the developing range in a direction of rotation of the latent image bearer. The second seal includes a first end secured to the opposing face of the casing, and a second end to contact the first seal upstream from the developing range. The third seal includes a first end secured to the opposing face of the casing, and a second end to contact developer on the developer bearer between the developer regulator and the developing range in the direction of rotation of the developer bearer.

14 Claims, 5 Drawing Sheets

(56) References Cited

U.S. PATENT DOCUMENTS

| | | | | |
|---|---|---|---|---|
| 2003/0059228 | A1* | 3/2003 | Tatsumi | G03G 15/0812 399/103 |
| 2008/0013982 | A1* | 1/2008 | Kimura | G03G 15/0898 399/103 |
| 2008/0317508 | A1 | 12/2008 | Terai et al. | |
| 2009/0080943 | A1 | 3/2009 | Kato et al. | |
| 2011/0222871 | A1 | 9/2011 | Suzuki et al. | |
| 2012/0051792 | A1 | 3/2012 | Matsumoto et al. | |
| 2012/0207492 | A1 | 8/2012 | Fujiwara et al. | |
| 2012/0219326 | A1 | 8/2012 | Koike et al. | |
| 2012/0230733 | A1 | 9/2012 | Kikuchi et al. | |
| 2012/0269544 | A1 | 10/2012 | Tsuda et al. | |
| 2013/0034368 | A1 | 2/2013 | Hattori et al. | |
| 2013/0045029 | A1 | 2/2013 | Kimura et al. | |
| 2013/0064570 | A1 | 3/2013 | Yamane et al. | |
| 2014/0016960 | A1 | 1/2014 | Miyoshi et al. | |
| 2014/0233984 | A1 | 8/2014 | Miyoshi et al. | |
| 2014/0341618 | A1 | 11/2014 | Otome et al. | |
| 2014/0376951 | A1 | 12/2014 | Ogawa et al. | |
| 2014/0376970 | A1 | 12/2014 | Kimura et al. | |
| 2015/0023700 | A1 | 1/2015 | Nakamoto et al. | |
| 2015/0147096 | A1 | 5/2015 | Hori et al. | |
| 2015/0234318 | A1 | 8/2015 | Takahashi et al. | |

* cited by examiner

DEVELOPING DEVICE, AND PROCESS CARTRIDGE AND IMAGE FORMING APPARATUS INCORPORATING SAME

CROSS-REFERENCE TO RELATED APPLICATIONS

This patent application is based on and claims priority pursuant to 35 U.S.C. §119(a) to Japanese Patent Application Nos. 2014-250587 filed on Dec. 11, 2014, 2015-011718 filed on Jan. 23, 2015, and 2015-107289 filed on May 27, 2015, in the Japan Patent Office, the entire disclosure of each of which is hereby incorporated by reference herein.

BACKGROUND

Technical Field

Embodiments of the present invention generally relate to a developing device, and a process cartridge and an image forming apparatus, such as a copier, a printer, a facsimile machine, or a multifunction peripheral having at least two of copying, printing, facsimile transmission, plotting, and scanning capabilities, which include the developing device.

There are developing devices that includes a scattering prevention sheet to close a gap between a surface of the photoconductor and a casing of the developing device to inhibit scattering of toner outside the device.

Description of the Related Art

Generally, image forming apparatuses include a latent image bearer such as a photoconductor and a developing device to develop, with toner, the latent image on the latent image bearer into a toner image.

SUMMARY

An embodiment of the present invention provides a developing device that includes a developer bearer disposed facing a latent image bearer to carry, by rotation, developer including toner to a developing range facing the latent image bearer and supply the toner to a latent image on the latent image bearer, a developer regulator disposed facing the developer bearer to adjust an amount of the developer on the developer bearer, a casing including an opposing face to oppose to a surface of the developer bearer upstream from the developing range in a direction of rotation of the developer bearer, a first seal, as second seal, and a third seal.

The first seal has a first end secured to the casing, and a second end to contact a surface of the latent image bearer at a position upstream from the developing range in a direction of rotation of the latent image bearer. The second seal has a first end secured to the opposing face of the casing, and a second end to contact the first seal at a position upstream from the developing range in the direction of rotation of the developer bearer. The third seal has a first end secured to the opposing face of the casing, and a second end to contact the developer on the developer bearer at a position downstream from the developer regulator and upstream from the developing range in the direction of rotation of the developer bearer.

In another embodiment, a process cartridge process removably installed in an image forming apparatus includes the latent image bearer and the developing device described above.

In yet another embodiment, an image forming apparatus includes the process cartridge described above.

In yet another embodiment, an image forming apparatus includes the latent image bearer and the developing device described above.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
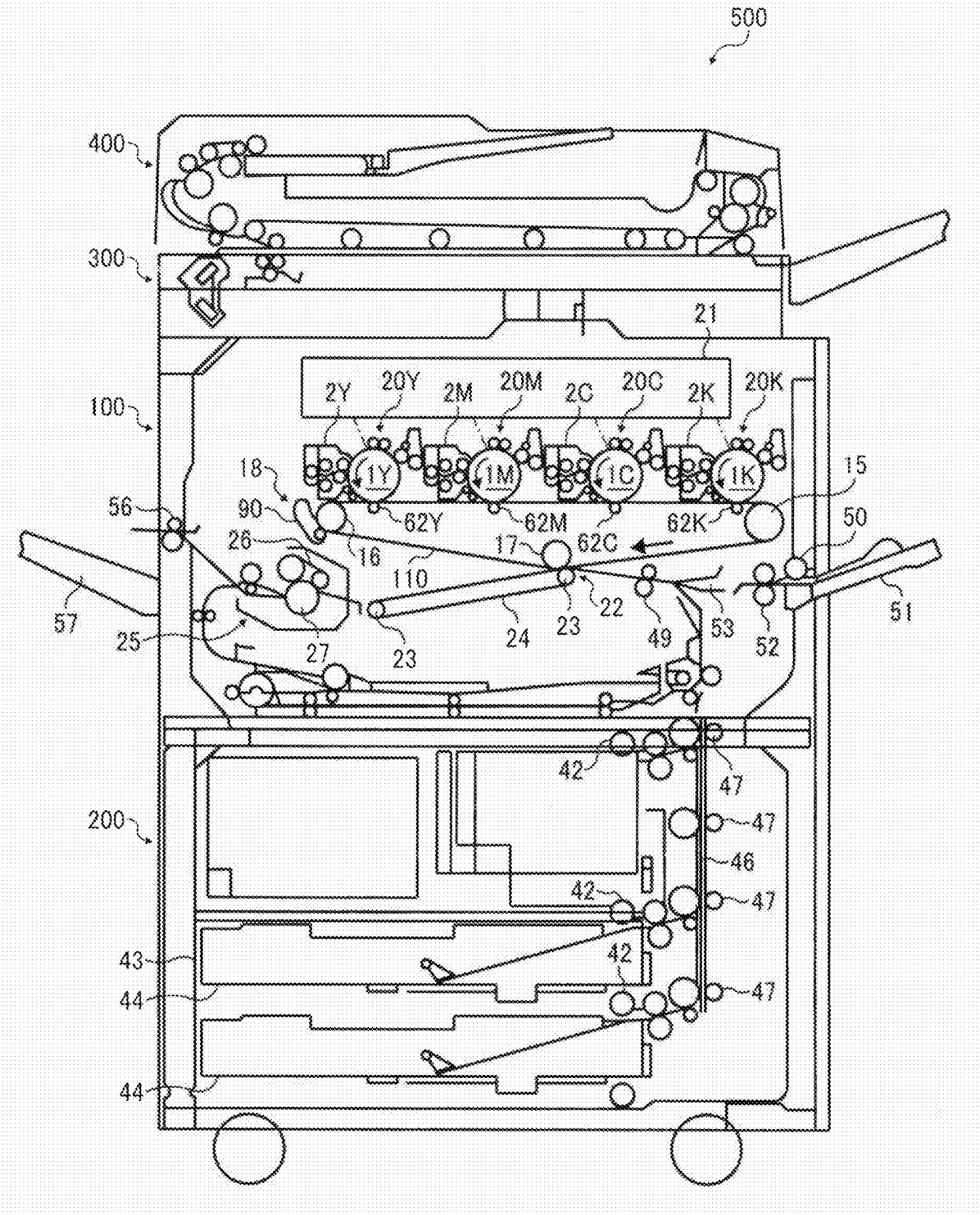
FIG. 1 is a schematic diagram illustrating an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a schematic diagram illustrating a configuration of the image forming apparatus according to the present embodiment.

An image forming apparatus 500 illustrated in FIG. 1 is, for example, a tandem-type multicolor laser printer including multiple photoconductors arranged in parallel. The image forming apparatus 500 can be, for example, a copier, and includes a printer body 100, a sheet feeder 200 on which the printer body 100 is mounted, and a scanner 300 secured on the printer body 100. The image forming apparatus 500 further includes an automatic document feeder (ADF) 400 attached on the scanner 300.

The printer body 100 includes four image forming units 20Y, 20M, 20C, and 20K for forming yellow (Y), magenta (M), cyan (C), and black (K) images. It is to be noted that suffixes Y, M, C, and K attached to each reference numeral indicate only that components indicated thereby are used for forming yellow, magenta, cyan, and black images, respectively, and hereinafter may be omitted when color discrimination is not necessary. The image forming apparatus 500 further includes an optical writing unit 21, an intermediate transfer unit 18, a secondary transfer device 22, a registration roller pair 49, and a belt-type fixing device 25.

The optical writing unit 21 includes a light source, a polygon mirror, an f-θ lens, and reflection mirrors, and is configured to direct a laser beam onto the surface of a photoconductor 1 according to image data.

In an embodiment, each image forming unit 20 is a modular unit (i.e., a process cartridge) removably installable in the image forming apparatus 500, and the image forming unit 20 includes a common casing to support the drum-shaped photoconductor 1 and the components disposed therearound, such as a charging device, a developing device 2, a drum cleaning device, and the discharger.

The image forming units 20 are described in further detail below using the image forming unit 20Y for yellow. The surface of the photoconductor 1Y is uniformly charged by the charging device. Then, the optical writing unit 21 directs the laser beam, which is modulated and deflected, to the charged surface of the photoconductor 1Y. The laser beam (exposure light) attenuates the electrical potential of the portion of the photoconductor 1Y thus exposed, forming an electrostatic latent image for yellow thereon. Then, the developing device 2Y develops the electrostatic latent image on the photoconductor 1Y into a yellow toner image. The yellow toner image is primarily transferred from the photoconductor 1Y onto the intermediate transfer belt 110. Subsequently, the drum cleaning device removes toner remaining on the surface of the photoconductor 1Y. Further, the discharger removes electrical potential remaining on the photoconductor 1Y, after which the charging device uniformly charges the surface of the photoconductor 1Y. Thus, the photoconductor 1Y is initialized. The above-described processes are also performed in other image forming units 20 similarly.

Next, the intermediate transfer unit 18 is described below. The intermediate transfer unit 18 includes the intermediate transfer belt 110, a belt cleaning device 90, a tension roller 15, a driving roller 16, a backup roller 17, and four primary-transfer bias rollers 62 (62Y, 62M, 62C, and 62K). The intermediate transfer belt 110 is entrained taut around multiple rollers including the tension roller 15 and rotates clockwise in FIG. 1 as the driving roller 16 rotates, driven by a belt driving motor. The four primary-transfer bias rollers 62 are disposed in contact with an inner circumferential surface of the intermediate transfer belt 110 and receive a primary transfer bias from a power supply.

The four primary-transfer bias rollers 62 press the intermediate transfer belt 110 against the photoconductors 1 from the inner circumferential side, forming primary transfer nips therebetween. The primary transfer bias causes a primary-transfer electrical field between the photoconductor 1 and the primary-transfer bias roller 62 in each primary transfer nip. The yellow toner image is transferred from the photoconductor 1Y onto the intermediate transfer belt 110 with the effects of the primary-transfer electrical field and the nip pressure. Subsequently, magenta, cyan, and black toner images are transferred from the photoconductors 1M, 1C, and 1K and superimposed one on another on the yellow toner image. Thus, a superimposed four-color toner image is formed on the intermediate transfer belt 110.

The four-color toner image on the intermediate transfer belt 110 is transferred onto a transfer sheet (i.e., a recording medium) in the secondary transfer nip (secondary transfer process). The belt cleaning device 90 is disposed downstream from the secondary transfer nip in the transfer sheet conveyance direction, pressing against the driving roller 16 via the intermediate transfer belt 110. The belt cleaning device 90 removes toner remaining on the intermediate transfer belt 110 after the secondary transfer process.

The secondary transfer device 22 is described in further detail below. The secondary transfer device 22 is disposed below the intermediate transfer unit 18 in FIG. 1 and includes a conveyor belt 24 looped around two tension rollers 23. The conveyor belt 24 rotates counterclockwise in FIG. 1 as at least one of the two tension rollers 23 rotates. The intermediate transfer belt 110 and the conveyor belt 24 are nipped between the backup roller 17 of the intermediate transfer unit 18 and the tension roller 23 on the right in FIG. 1. Thus, the intermediate transfer belt 110 of the intermediate transfer unit 18 is in contact with the conveyor belt 24 of the secondary transfer device 22, forming the secondary transfer nip.

A secondary transfer bias opposite in polarity to the toner is applied to the tension roller 23 on the right from a power supply. The secondary transfer bias causes secondary-transfer electrical field in the secondary transfer nip to electrically transfer the four-color toner image from the intermediate transfer belt 110 of the intermediate transfer unit 18 toward the tension roller 23. Timed to coincide with transferring of the four-color toner image, the registration roller pair 49 forwards the transfer sheet to the secondary transfer nip, and the four-color toner image is secondarily transferred on the transfer sheet. It is to be noted that, instead of applying the secondary transfer bias to one of the tension rollers 23, a contactless charger to charge the transfer sheet may be used.

The sheet feeder 200 disposed below the printer body 100 of the apparatus includes a paper bank 43 in which multiple sheet feeding trays 44 are arranged vertically. Each sheet feeding tray 44 contains multiple sheets stacked on top of another. Each sheet feeding tray 44 is provided with a sheet feeding roller 42 pressed against the transfer sheet on the top in the sheet feeding tray 44. As the sheet feeding roller 42 rotates, the transfer sheet is conveyed to a sheet feeding path 46.

Multiple pairs of conveyance rollers 47 are disposed along the sheet feeding path 46 to feed the transfer sheet to the registration roller pair 49, which is positioned close to an end of the sheet feeding path 46. Then, the transfer sheet is nipped between the registration roller pair 49. Alternatively, a sheet feeding roller 50 feeds transfer sheets on a side tray 51 (i.e., a bypass tray). Then, a separation roller 52 separates the transfer sheets one by one and feeds the transfer sheet to a sheet feeding path 53. Subsequently, the registration roller pair 49 stops the transfer sheet similarly.

Meanwhile, in the intermediate transfer unit 18, the four-color toner image on the intermediate transfer belt 110 is transported to the secondary transfer nip as the intermediate transfer belt 110 rotates. The registration roller pair 49 forwards the transfer sheet nipped therein so that the transfer sheet contacts the four-color image in the secondary transfer nip. Thus, the four-color toner image is transferred onto the transfer sheet in the secondary transfer nip, forming a full-color image on the while sheet. As the conveyor belt 24 rotates, the transfer sheet carrying the full-color toner image is discharged from the secondary transfer nip and conveyed to the fixing device 25.

The fixing device 25 includes a belt unit to rotate a fixing belt 26 looped around two rollers as well as a pressure roller 27 pressed against one of the two rollers of the belt unit. The fixing belt 26 and the pressure roller 27 press against each other, forming a fixing nip therebetween, and the transfer sheet conveyed by the conveyor belt 24 is clamped in the fixing nip. A heat source is disposed inside the roller against which the pressure roller 27 presses to heat the fixing belt 26. With the heat and pressure, the toner image is fixed on the transfer sheet in the fixing nip (fixing process).

After the fixing process, discharge rollers 56 discharge the transfer sheet to a stack tray 57 protruding from a side plate of the housing of the apparatus on the left in FIG. 1. Alternatively, the transfer sheet is conveyed again to the secondary transfer nip for duplex printing.

Figure 2:
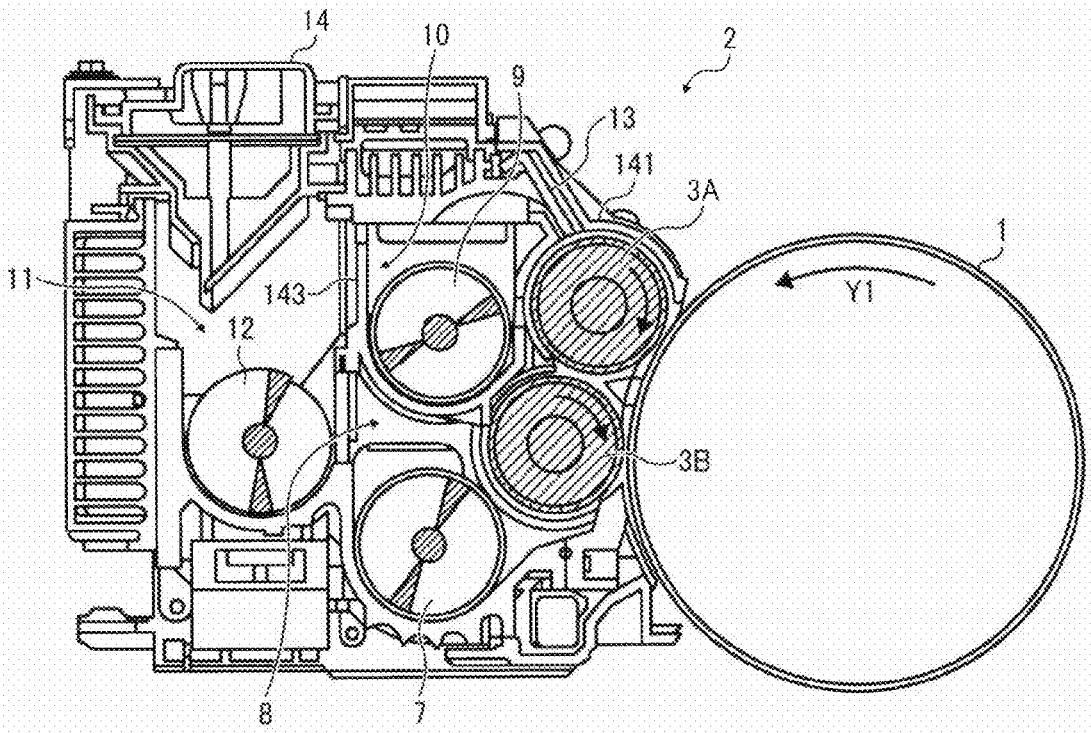
FIG. 2 is a schematic end-on axial view illustrating a configuration of a developing device of the image forming apparatus illustrated in FIG. 1.

FIG. 2 is a schematic end-on axial view illustrating a configuration of the developing device 2 of the image forming unit 20.

It is to be noted that the four developing devices 2Y, 2M, 2C, and 2K are similar in configuration except the color of toner used therein, and the subscripts Y, K, M, and C attached to the end of reference numerals are omitted in FIG. 2.

The developing device 2 employs multistage development and includes a first developing roller 3A and a second developing roller 3B, serving as first and second developer bearers, to bear two-component developer including toner and magnetic carrier. The developing device 2 includes the two developing rollers, namely, the first and second developing rollers 3A and 3B, and a development casing 14 to contain the developer.

The development casing 14 has an opening positioned facing the photoconductor 1, which rotates counterclockwise in FIG. 2 as indicated by arrow Y1, and the first and second developing rollers 3A and 3B are partly exposed from the opening. The first and second developing rollers 3A and 3B rotate clockwise in FIG. 2.

The first and second developing rollers 3A and 3B are disposed so that a minute clearance is kept between the exposed surfaces thereof and the surface of the photoconductor 1. The first and second developing rollers 3A and 3B are adjacent to each other in the direction of rotation of the photoconductor 1. The second developing roller 3B is disposed downstream from the first developing roller 3A in the direction of rotation of the photoconductor 1.

Each of the first and second developing rollers 3A and 3B includes a cylindrical developing sleeve made of a conductive, nonmagnetic material and a magnet roller serving as a magnetic field generator, disposed inside the developing sleeve. The magnet roller includes multiple stationary magnetic poles. The second developing roller 3B is similar in configuration to the first developing roller 3A.

The developing sleeve of each of the first and second developing rollers 3A and 3B rotates, thus moving relatively to the magnet roller, in a direction following the rotation of the photoconductor 1.

Further, a power supply is connected to the developing sleeve to apply a developing bias thereto. When the developing bias is applied to the developing sleeve, an electrical field (i.e., development field) is generated in a first developing range and a second developing range, respectively. In the first developing range, the surface of the first developing roller 3A faces the surface of the photoconductor 1. In the second developing range, the surface of the second developing roller 3B faces the surface of the photoconductor 1. The development fields cause toner contained in the developer carried on the surface of each of the first and second developing rollers 3A and 3B to adhere to the electrostatic latent image on the photoconductor 1, thus developing it into a toner image. In image development, in the first and second developing ranges, the magnetic carrier in the developer stands on end on the first and second developing rollers 3A and 3B due to the magnetic field generated by the magnet roller. Thus, magnetic brushes are formed.

The developing device 2 further includes a doctor blade 13 serving as a developer regulator that adjusts the amount of developer carried on the first developing roller 3A and conveyed to the developing range. It is to be noted that the term "regulation position" means the position where the doctor blade 13 adjusts the amount of developer on the first developing roller 3A, that is, the position where the end of the doctor blade 13 faces the surface of the first developing roller 3A. Further, first, second, and third entrance seals 4, 5, and 6 (illustrated in FIG. 3) are disposed at an opening peripheral part 141 of the development casing 14 adjacent to the opening.

The developing device 2 further includes a supply screw 9 and a collecting screw 7, serving as developer conveyors. The supply screw 9 transports the developer to the front side of the paper on which FIG. 2 is drawn while supplying the developer to the first developing roller 3A. The collecting screw 7 collects the developer that has passed through the developing range and transports the collected developer in the direction identical to the direction in which the supply screw 9 transports the developer (hereinafter "developer conveyance direction"). A supply compartment 10, in which the supply screw 9 is disposed, is on a side of the first and second developing rollers 3A and 3B in FIG. 2. A collecting compartment 8, in which the collecting screw 7 is disposed, is positioned below the second developing roller 3B in FIG. 2. The developing device 2 further includes an agitation compartment 11 below the supply compartment 10 and in parallel to the collecting compartment 8. In the agitation compartment 11, an agitation screw 12 is disposed to transport the developer toward the back side of the paper on which FIG. 2 is drawn, while agitating the developer. The agitation screw 12 (e.g., stirring screw) transports the developer in the direction opposite the developer conveyance direction of the supply screw 9.

Figure 3:
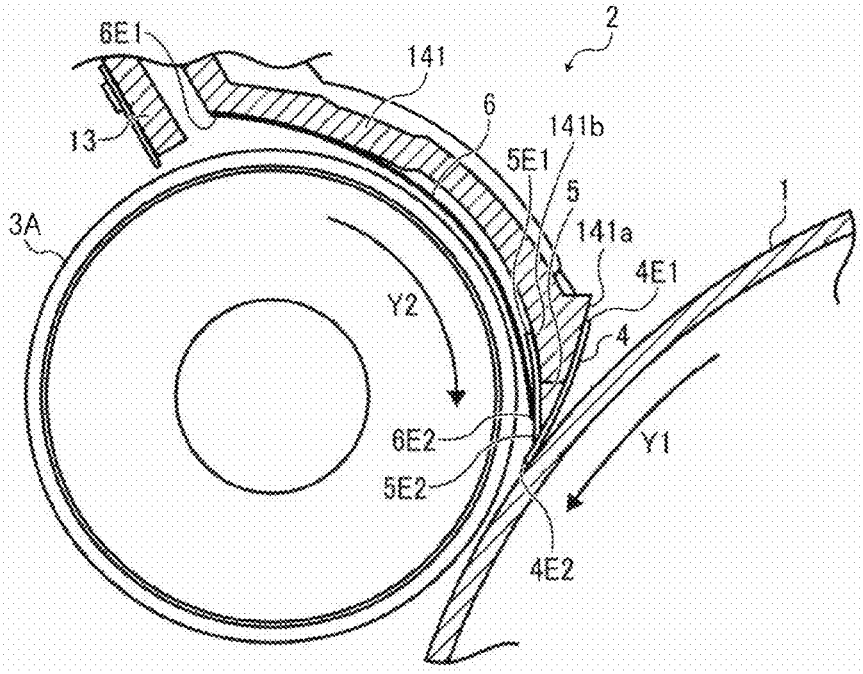
FIG. 3 is an enlarged view around a position where a first developing roller of the developing device illustrated in FIG. 2 faces a photoconductor.

The developing device 2 further includes a first partition 143 (i.e., a separation wall) that separates the supply compartment 10 from the agitation compartment 11. Although separated by the first partition 143, the supply compartment 10 and the agitation compartment 11 communicate with each other in both end portions in the direction perpendicular to the surface of paper on which FIG. 3 is drawn, through openings, namely, a first communication portion and a third communication portion respectively formed on the front side and the back side of the paper. Additionally, a second partition partly separates the agitation compartment 11 from the collecting compartment 8. Although separated by the second partition, an opening (second communication portion) through which the agitation compartment 11 communicates with the collecting compartment 8 is in the second partition, in an end portion, that is, on the front side of paper on which FIG. 2 is drawn. It is to be noted that the supply compartment 10 and the collecting compartment 8 are separated by the first partition 143 as well, and no opening is in that portion of the first partition 143. Thus, the supply compartment 10 does not communicate with the collecting compartment 8.

After used in image development, the developer is collected in the collecting compartment 8 and then is conveyed to the front side of the paper on which FIG. 2 is drawn. The collected developer is further conveyed through the opening (second communication portion) in the second partition, in a non-image area, to the agitation compartment 11. It is to be noted that premixed toner, in which toner and carrier are mixed, is supplied to the agitation compartment 11 through a toner supply inlet formed on an upper side of the agitation compartment 11, positioned close to the opening in the first partition 143.

Next, circulation of developer inside the three compartments in the development casing 14 (i.e., a developer container) is described below.

In the supply compartment 10, the supply screw 9 transports the developer supplied from the agitation compartment 11 downstream while supplying the developer to the first developing roller 3A. As the first developing roller 3A rotates, the developer supplied to the first developing roller 3A is transported through the first developing range to a developer receiving area facing a developer receiving magnetic pole inside the second developing roller 3B. In the developer receiving area, the developer is partly or entirely transferred from the first developing roller 3A to the second developing roller 3B and carried thereon due to the magnetic force exerted by the developer receiving magnetic pole.

The developer carried on the second developing roller 3B is transported to a second developing range facing the photoconductor 1. After passing through the second developing range, the developer carried on the second developing roller 3B is separated from the second developing roller 3B and sent to the collecting compartment 8. The collecting screw 7 transports the developer in the collecting compartment 8. Then, the developer is supplied from the downstream end of the collecting compartment 8 to the agitation compartment 11 through the opening or second communication portion in the second partition. In the agitation compartment 11, the agitation screw 12 transports the developer to the downstream end of the agitation compartment 11, which is on the upstream side in the conveyance direction of the supply screw 9. Then, the developer is transported through the opening in the first partition 143 to the supply compartment 10. It is to be noted that a toner concentration sensor is disposed below the agitation compartment 11. According to outputs from the toner concentration sensor, a toner supply controller instructs supply of toner from a toner container.

Use of a multistage developing device that include multiple developer bearers is advantageous in that the number of times the latent image on the latent image bearer is developed increases, and the developing capability increases compared with a single-stage developing device including only one developing roller. Although the developing capability tends to decrease as the rotation speed of the latent image bearer increases to increase the image formation speed, such a decrease can be supplemented in the multistage developing device.

Additionally, in typical developing devices, a developer regulator adjusts the amount of developer carried on the developer bearer. Then, the developer is transported to the developing range facing the latent image bearer (e.g., a photoconductor) as the developer bearer rotates. At that time, the developer is subject to centrifugal force or an airflow inside the developing device, and it is possible that the developer (i.e., carrier particles or toner particles) is scattered inside or outside the developing device. If developer scatters outside a development casing to contain developer, it is possible that the developer adheres to the latent image bearer upstream from the developing range in the direction in which the latent image bearer rotates, resulting in contamination inside the image forming apparatus.

Therefore, typically a sheet to prevent scattering of developer (hereinafter "scattering prevention sheet") is disposed to fill in a clearance between the edge portion of the development casing adjacent to the opening (i.e., an opening peripheral part) and the surface of the latent image bearer on the upstream side in the direction of rotation of the latent image bearer, thereby preventing the developer from scattering. However, the contact of the scattering prevention sheet with the latent image bearer becomes unstable as the rotation speed of the latent image bearer increases to increase the image formation speed. Then, it becomes difficult to inhibit developer scattering. In view of the foregoing, the developing device 2 according to the present embodiment includes, as the scattering prevention sheets, the first entrance seal 4, the second entrance seal 5, and the third entrance seal 6 to enhance inhibition of developer scattering.

Next, as a specific feature of the first embodiment, the first, second, and third entrance seals 4, 5, and 6 are described below.

FIG. 3 is an enlarged view around a position where the first developing roller 3A faces the photoconductor 1.

As illustrated in FIG. 3, a first end 4E1 of the first entrance seal 4 and a first end 5E1 of the second entrance seal 5 are attached to the opening peripheral part 141, which is positioned upstream from the developing range in the direction of rotation of the first developing roller 3A indicated by arrow Y2. A second end 4E2 of the first entrance seal 4 and a second end 5E2 of the second entrance seal 5 are free ends (not secured) and oriented to the developing range. The first and second entrance seals 4 and 5 are elastic sheets made of, for example, resin such as polyurethane (PUR) resin and polyethylene terephthalate (PET) resin. Thus, the first and second entrance seals 4 and 5 are flexible.

Specifically, the first end 4E1 of the first entrance seal 4 is attached to an end face of the opening peripheral part 141 positioned upstream from the developing range in the direction of rotation of the first developing roller 3A. At the position upstream from the developing range in the direction of rotation of the photoconductor 1, the second end 4E2 (free end) of the first entrance seal 4 is disposed to contact the surface of the photoconductor 1 in a trailing direction. With this configuration, the first entrance seal 4 closes the clearance between the opening peripheral part 141 of the development casing 14 and the surface of the photoconductor 1. Accordingly, the first entrance seal 4 inhibits scattering, to outside the development casing 14, of the developer that has passed through the regulation position facing the doctor blade 13.

It is preferred that the first entrance seal 4 is attached to the opening peripheral part 141 such that the angle of contact of the first entrance seal 4 with the photoconductor 1 is constant. The opening peripheral part 141 includes a mount face 141*a*, to which the first entrance seal 4 is attached. Regarding the angle of contact of the first entrance seal 4, for example, it is preferable that an angle between a line extending from the mount face 141*a* and a line tangential to the point of contact with the photoconductor 1 be about 20 degrees to 40 degrees. If the angle of contact is too large, the amount of sagging of the first entrance seal 4 increases, and inhibition of the toner scattering is degraded.

Additionally, if the length of the unsecured portion (i.e., free end) of the first entrance seal 4 in the direction of rotation of the first developing roller 3A is extremely long, the first entrance seal 4 easily sags. Accordingly, the unsecured portion of the first entrance seal 4 is preferably about 4 mm to 7 mm to secure the capability to inhibit scattering of toner. It is to be noted that, when the total length of the first entrance seal 4 means the sum of the unsecured portion and a secured portion attached to the mount face 141*a*, the ratio of the unsecured portion to the total length of the first entrance seal 4 changes depending on the length of the secured portion. For example, the first entrance seal 4 is attached to the mount face 141*a* via double-sided adhesive tape. When the first entrance seal 4 is attached to the mount face 141*a* using double-sided adhesive tape of about 3 mm to 6 mm, the ratio of the unsecured portion is about 40% to 70% of the total length of the first entrance seal 4.

Additionally, the first entrance seal 4 is preferably made of a flexible material such as a urethane sheet and about 0.2 mm in thickness. If the first entrance seal 4 is extremely thin, the contact pressure of the first entrance seal 4 to the photoconductor 1 becomes smaller, and the capability to inhibit toner scattering is reduced.

If the first entrance seal 4 is extremely thick, the stress on the photoconductor 1 caused by the contact pressure of the first entrance seal 4 increases, and the photoconductor 1 wears. If the first entrance seal 4 is extremely thick, the first entrance seal 4 is less likely to sag, and it is difficult to secure a nip (width) between the first entrance seal 4 and the photoconductor 1. Then, capability to inhibit toner scattering is reduced. It is preferable that, to secure the nip between the photoconductor 1 and the first entrance seal 4, the amount by which first entrance seal 4 bites in the photoconductor 1 is about 1 mm.

The first end 5E1 of the second entrance seal 5 is attached to an inner wall (opposing face) of the opening peripheral part 141. More specifically, the first end 5E1 is attached to an attachment range 141*b* of the inner wall of the opening peripheral part 141. The second end 5E2 of the second entrance seal 5 is disposed upstream from the developing range in the direction of rotation of the photoconductor 1. The second end 5E2 is disposed to contact the first entrance seal 4. With this configuration, the second entrance seal 5 contacts the first entrance seal 4, thereby assisting the first entrance seal 4 to contact the surface of the photoconductor 1. Accordingly, the first entrance seal 4 better inhibits scattering of toner to the outside of the development casing 14. This configuration is advantageous over a developing device in which the clearance between the photoconductor and the opening of the development casing is closed with a single scattering prevention sheet. Specifically, according to the present embodiment, toner is better inhibited from scattering outside the developing device even when the contact between the first entrance seal 4 and the photoconductor 1 is stable due to the increased rotation speed of the photoconductor 1.

Additionally, the free second end 5E2 of the second entrance seal 5 is positioned upstream from the second end 4E2 of the first entrance seal 4 in the direction of rotation of the photoconductor 1. With this configuration, without contacting the photoconductor 1, the second entrance seal 5 assists the contact of the first entrance seal 4 with the surface of the photoconductor 1.

It is to be noted that the second entrance seal 5 preferably has a thickness of about 0.1 mm to 0.2 mm. If the second entrance seal 5 is thicker than the first entrance seal 4, there is a risk that the second entrance seal 5 excessively presses the first entrance seal 4 to the photoconductor 1. In that case, the angle at which the second end 4E2 of the first entrance seal 4 contacts the photoconductor 1 is out of the preferable range. If the second entrance seal 5 is extremely thin, the contact pressure of the first entrance seal 4 to the photoconductor 1 decreases, and the capability to inhibit toner scattering is reduced.

Figure 4:
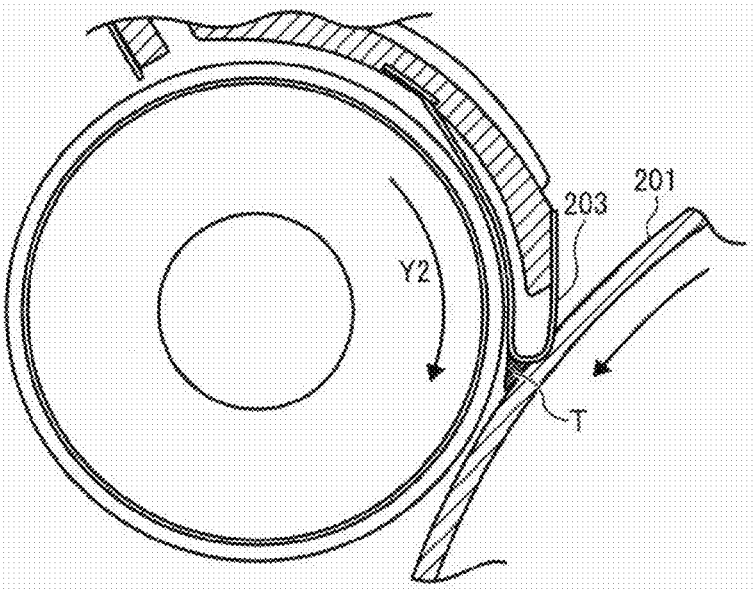
FIG. 4 is an enlarged view around a position where a developing roller faces a photoconductor in a comparative example.

FIG. 4 is an enlarged view around a position where a developing roller faces a photoconductor in a comparative example.

In FIG. 4, a scattering prevention sheet 203 serving as an entrance seal is folded like a bag to increase the size of a contact nip with the latent image bearer, thereby sealing the clearance between the latent image bearer and the casing. In the comparative example illustrated in FIG. 4, scattering toner T tends to accumulates on a curled end portion of the scattering prevention sheet 203. Receiving an impact, the accumulating toner T can drop and degrade image quality.

By contrast, the developing device 2 according to the present embodiment includes the third entrance seal 6 in addition to the first and second entrance seals 4 and 5.

The third entrance seal 6 is an elastic sheet made of, for example, polyurethane (PUR) resin and polyethylene terephthalate (PET) resin. Thus, the third entrance seal 6 is flexible. As illustrated in FIG. 3, a first end 6E1 of the third entrance seal 6 is attached to the inner wall of the opening peripheral part 141 of the development casing 14 at a position farther from the photoconductor 1 and closer to the doctor blade 13 than the first entrance seal 4. The second end 6E2 (free end) of the third entrance seal 6 drapes into an arc under its own weight.

The draping second end 6E2 is disposed to contact the developer that has passed by the doctor blade 13 and not yet reached the developing range. A gap between the surface of the first developing roller 3A and the third entrance seal 6 is designed so that a face of the third entrance seal 6 facing the first developing roller 3A contacts a tip of the magnetic brush on the first developing roller 3A.

With this arrangement, the tip of the magnetic brush of developer carried by the first developing roller 3A rubs on the face of the third entrance seal 6 facing the first developing roller 3A. Then, accumulation of developer on the third entrance seal 6 and drop of aggregated toner therefrom are inhibited.

Additionally, the third entrance seal 6 that contacts the developer on the first developing roller 3A is not taut but drapes under its own weight. Accordingly, the stress on the developer caused by the contact between the third entrance seal 6 and the developer is reduced or eliminated regardless of whether the developer stands on end (into the magnetic brush) or lies on the first developing roller 3A. Compared with a case where both ends of the entrance seal are secured, unevenness in the developer conveyed can be reduced.

Additionally, the third entrance seal 6 is kept slack into an arc with a predetermined gap secured between the first developing roller 3A and the third entrance seal 6. Thus, the third entrance seal 6 can softly contact the tip of the magnetic brush on the first developing roller 3A with the stress on the developer reduced. As a result, developer is less likely to adhere to the face of the third entrance seal 6 facing the first developing roller 3A, thus preventing accumulation of developer thereon.

Further, letting the second end 6E2 of the third entrance seal 6 sag under the gravity makes the placement of the third entrance seal 6 easier compared with a case where the second end 6E2 of the third entrance seal 6 is kept in contact with an end of another seal to secure the third entrance seal 6 in the developing device 2.

It is to be noted that, since the third entrance seal 6 is caused to sag under the gravity, the third entrance seal 6 is preferably about 0.05 mm in thickness to facilitate the sagging.

Additionally, the second end 5E2 (free end) of the second entrance seal 5 is disposed so that the second entrance seal 5 contacts the third entrance seal 6 when the developing device 2 is in position to develop the latent image on the photoconductor 1.

Specifically, when the developing device 2 is set in position to develop the latent image on the photoconductor 1, the free second end 5E2 of the second entrance seal 5 is disposed downstream from the free second end 6E2 of the third entrance seal 6 in the direction of rotation of the photoconductor 1.

With this configuration, when the developing device 2 is in position to develop the latent image on the photoconductor 1, the second entrance seal 5 is pressed via the first entrance seal 4 to the photoconductor 1 and sags, and the second entrance seal 5 contacts the third entrance seal 6. Since the second entrance seal 5 contacts the third entrance seal 6, the third entrance seal 6 is reliably pushed to the first developing roller 3A. Accordingly, the face of the third entrance seal 6 facing the first developing roller 3A is rubbed by the tip of magnetic brush of developer on the first developing roller 3A. This configuration inhibits accumulation of developer on the face of the third entrance seal 6 facing the first developing roller 3A and inconveniences caused by the toner aggregation falling therefrom.

Figure 5:
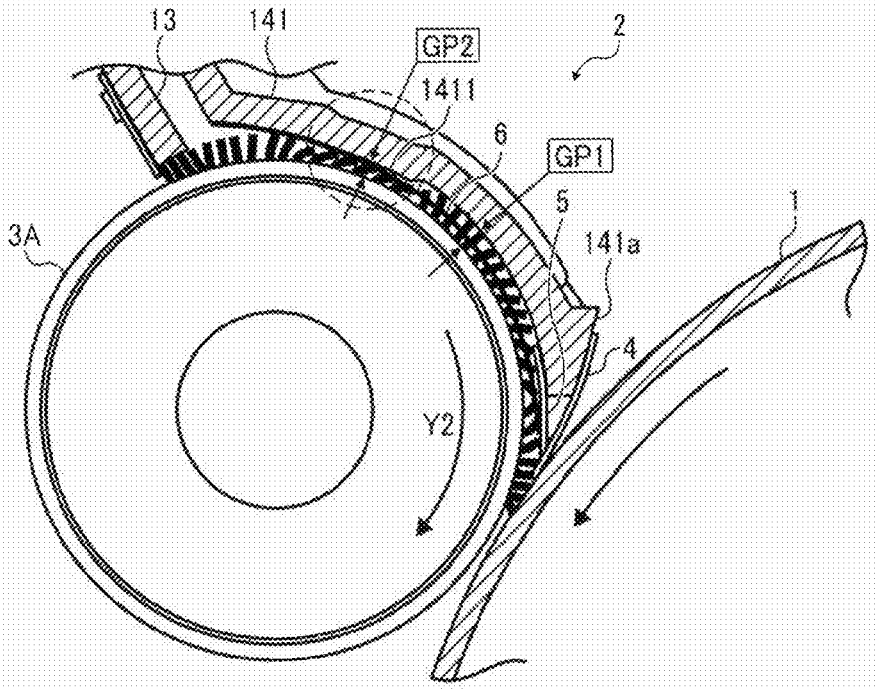
FIG. 5 is an enlarged view of a gap between an opening peripheral part of a development casing and the first developing roller.

Additionally, in the present embodiment, the gap GP1 between the first developing roller 3A and the opening peripheral part 141, which faces the first developing roller 3A via the second entrance seal 5 and the third entrance seal 6, is reduced partly) in the direction of rotation of the first developing roller 3A, as illustrated in FIG. 5.

Descriptions are given below of the gap GP1 between the opening peripheral part 141 and the first developing roller 3A.

FIG. 5 is an enlarged end-on axial view of the gap GP1 between the opening peripheral part 141 of the development casing 14 and the first developing roller 3A.

Figure 6:
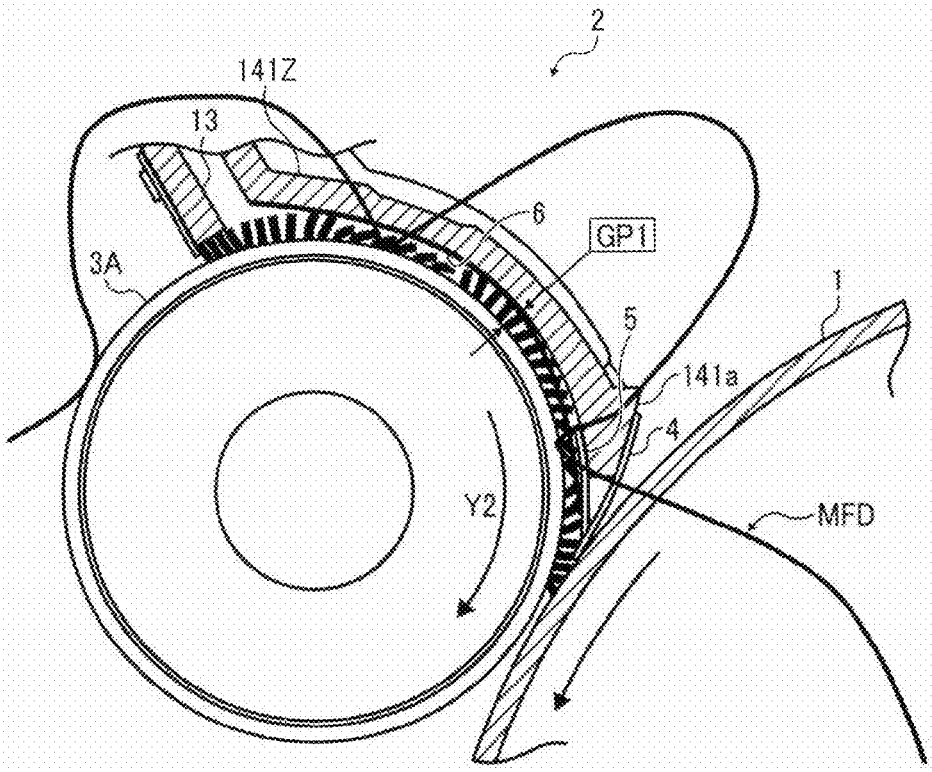
FIG. 6 is an enlarged cross section of a developing device in which the gap between the opening peripheral part and the developing roller is substantially uniform, together with magnetic flux density.

FIG. 6 is an enlarged end-on axial view of the first developing roller 3A and an opening peripheral part 141Z according to a comparative example, together with a curved line MFD representing magnetic flux density in normal direction of the first developing roller 3A. In FIG. 6, the gap GP1 between the first developing roller 3A and the opening peripheral part 141Z is almost equal.

Figures 7A, 7B:
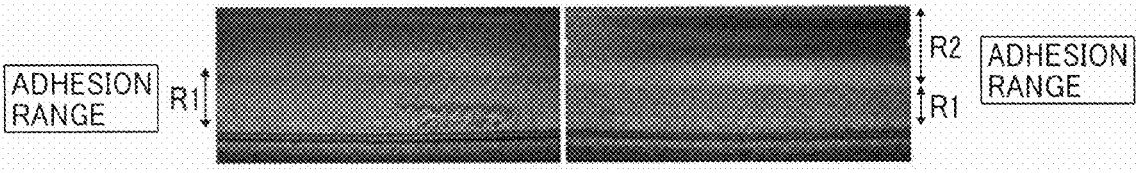
FIGS. 7A and 7B are photographs of toner adhering to a third entrance seal facing developer bristles lying down on the first developing roller.

FIGS. 7A and 7B are photographs of toner adhering to a part of the third entrance seal 6 facing the lying developer bristles for understanding of accumulation of toner on the third entrance seal 6.

FIG. 7A illustrates the toner on the third entrance seal 6 when the gap GP1 between the opening peripheral part 141 and the first developing roller 3A is equal or almost equal as illustrated in FIG. 6. FIG. 7B illustrates the toner on the third entrance seal 6 when the gap GP1 between the opening peripheral part 141 and the first developing roller 3A is changed to the GP2 depending on the state of the magnetic brush. FIGS. 7A and 7B are photographs of magenta toner adhering to the third entrance seal 6 that is semitransparent, on black backgrounds, and the magenta toner is in grayscale. The photographs in FIGS. 7A and 7B were taken after the developing device 2M was driven for an identical period.

The upper side and the lower side in FIGS. 7A and 7B respectively correspond to the downstream side and the upstream side in the direction of rotation of the first developing roller 3A.

As described above, the third entrance seal 6 sags under its own weight and disposed to contact the tip of magnetic brush on the first developing roller 3A without causing stress on the developer regardless of whether the developer stands on end (into the magnetic brush) or lies down on the first developing roller 3A.

In the present embodiment, the opening peripheral part 141 of the development casing 14 includes a bulge 1411 (in FIG. 5) facing a range enclosed with broken lines in FIG. 5, where the developer lies down. Then, the gap GP2 between the bulge 1411 and the first developing roller 3A is narrower than the gap GP1.

The state of the bristles of the magnetic brush on the first developing roller 3A depends on the magnetic poles of the magnet roller inside the first developing roller 3A, and the magnetic pole arrangement is known from the magnetic flux density in the normal direction, represented by the curved line MFD.

In the configuration in which the gap GP1 between the opening peripheral part 141 and the first developing roller 3A is almost equal as in FIG. 6, the distance to the third entrance seal 6 from the first developing roller 3A, which is determined by the opening peripheral part 141, is almost equal. Accordingly, the part of the third entrance seal 6 facing the magnetic brush lying down is pushed up by the developer standing on end (magnetic brush) upstream and downstream from the lying developer bristles, and that part of the third entrance seal 6 moves away from the first developing roller 3A. In that state, the chance of rubbing off toner from the third entrance seal 6 with the bristles of the magnetic brush is reduced.

If the chance is reduced, a greater amount of toner adheres to a belt-shaped adhesion range R1 (illustrated in FIG. 7A) of the third entrance seal 6 facing the lying developer bristles. The range (in the direction of rotation of the first developing roller 3A) and thickness of the toner accumulating in the adhesion range R1 grow to a position where the chance of rubbing off toner with the magnetic brush is greater. Accordingly, there is a risk that a large toner aggregation drops from the toner accumulation to cause image failure although the toner aggregations are expected to be smaller than the toner aggregations falling upon vibration or the like from the end of the scattering prevention sheet 203 shaped like a bag, illustrated in FIG. 4.

By contrast, in FIG. 5, the gap GP1 between the first developing roller 3A and the opening peripheral part 141 is reduced to the gap GP2 in the range where the magnetic brush lies down, and thus the amount by which the third entrance seal 6 moves away from the first developing roller 3A is restricted partly. This restriction is advantageous in inhibiting the part of the third entrance seal 6 facing the lying developer bristles from being pushed up by the magnetic brush upstream and downstream from the lying developer bristles, thereby securing the chance of rubbing off toner from the third entrance seal 6.

Accordingly, the adhesion range R1 in FIG. 7B is smaller in range (in the direction of rotation of the first developing roller 3A) and thickness than the adhesion range R1 in FIG. 7A.

Therefore, while reducing the adhesion range R1 on the third entrance seal 6 facing the lying developer bristles, the amount of accumulating toner is reduced, and drop of toner aggregations to the first developing roller 3A upon vibration or the like is inhibited. Even if toner drops, the toner aggregations are smaller in size and thickness, thereby alleviating the inconveniences caused by the drop, compared with the configuration illustrated in FIG. 6, in which the gap GP1 between the opening peripheral part 141Z and the first developing roller 3A is uniform.

It is to be noted that, the bulge 1411 and the opening peripheral part 141 can be molded as a single piece as illustrated in FIGS. 3 and 5. Alternatively, the bulge 1411 is a separate component jointed to the opening peripheral part 141.

For example, the bulge 1411 can be a gap adjuster made of resin or the like and attached to the opening peripheral part 141 to reduce, partly, the gap GP1 between the opening peripheral part 141 and the first developing roller 3A to the gap GP2. That is, the gap adjuster, a separate component, can be attached to the opening peripheral part 141 to reduce the gap GP1 between the first developing roller 3A and the opening peripheral part 141 of the development casing 14.

This configuration can attain a similar effect to the effect attained by the bulge 1411 molded as a single piece together with the opening peripheral part 141. Attaching the separate component to the opening peripheral part 141 is advantageous in that a mold shape to form the development casing 14 is simplified, thereby reducing the cost. Additionally, attaching the separate component facilitates position change of the magnetic poles of the first developing roller 3A or the like.

In FIG. 7A, the magenta toner is densest in a thick, ribbon-like range below a thin the range extending horizontally at a height of the upper arrowhead of the double-headed arrow representing the adhesion range R1. In this range, the toner not rubbed off by the magnetic brush but accumulates on the third entrance seal 6 is thickest, and the amount per unit area of toner adhering is greatest.

By contrast, the developer stands on end on, forming the magnetic brush, in a range R2 illustrated in FIG. 7B above the thin the range extending horizontally at a height of the upper arrowhead of the double-headed arrow. The magnetic brush rubs off the toner from the range R2. In FIG. 7B, the developer lies down in the range facing the adhesion range R1 on the third entrance seal 6. Accordingly, the bulge 1411 or the gap adjuster is disposed in the part of the opening peripheral part 141 facing the adhesion range R1 on the third entrance seal 6 in FIG. 7B.

Additionally, in the configuration including the bulge 1411 or the gap adjuster to partly reduce the gap between the first developing roller 3A and the third entrance seal 6, the adhesion range R1 is reduced in the direction of rotation of the first developing roller 3A (vertical direction in FIG. 7B) as illustrated in FIG. 7B, compared with the configuration in which the gap is uniform. In addition, n FIG. 7B, the density of magenta toner in the adhesion range R1 is generally lower than that in FIG. 7A.

From FIG. 7B, it is known that the configuration in which the gap with the first developing roller 3A is partly reduced is advantageous in reducing the range and the amount of accumulating toner on the part of the third entrance seal 6 facing the developer bristles lying down.

In a test device used to take the photograph shown in FIG. 7A, the development casing 14 includes the opening peripheral part 141Z illustrated in FIG. 6. To take the photograph shown in FIG. 7B, to form the bulge 1411 illustrated in FIG. 5, the gap adjuster (i.e., a filler) is attached to the opening peripheral part 141 to make the gap GP2 narrower than the gap GP1 between the opening peripheral part 141 and the first developing roller 3A. As described above, the gap adjuster can be made of resin and attached, via double-sided adhesive tape, to the opening peripheral part 141 that faces the lying developer bristles.

It is preferable that the gap GP2 is smaller by about 0.2 mm to 0.5 mm than the gap GP1, and the gap GP2 is equal to or greater than about 1.0 mm. If the gap GP2 is extremely narrow, the developer on the first developing roller 3A is blocked and does not pass through the clearance between the first developing roller 3A and the third entrance seal 6 that is secured not to move. Then, the developer accumulates upstream from the gap GP2 in the direction of rotation of the first developing roller 3A.

Additionally, in the developing device 2 according to the present embodiment, the gap GP1 between the opening peripheral part 141 and the first developing roller 3A can be made narrower at a position downstream from the attachment range 141*b*, to which the second entrance seal 5 is secured, in the direction of rotation of the first developing roller 3A.

Figure 8:
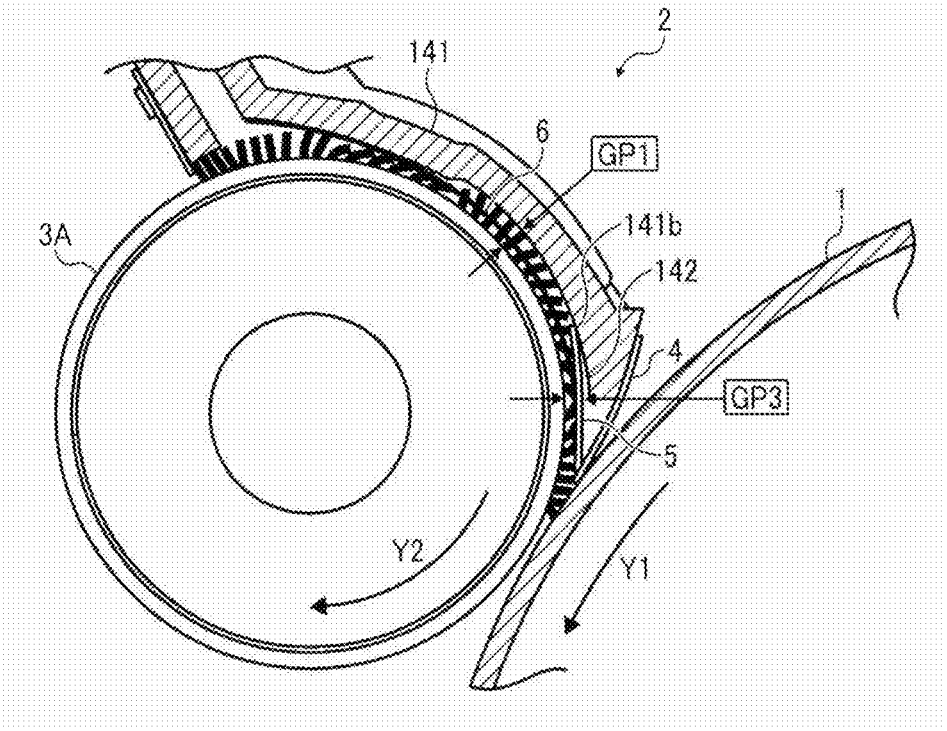
FIG. 8 is an enlarged view of the gap between the opening peripheral part and the first developing roller when the opening peripheral part includes a bulge.

With reference to FIG. 8, descriptions are given below of a configuration and reasons to reduce the gap downstream from the attachment range 141*b* of the opening peripheral part 141, to which the second entrance seal 5 is attached.

FIG. 8 is an enlarged view of the gap between the opening peripheral part 141 and the first developing roller 3A when the opening peripheral part 141 includes a downstream bulge 142.

In the developing device 2 illustrated in FIG. 8, in the opening peripheral part 141, the downstream bulge 142 is positioned downstream from the attachment range 141*b* to which the second entrance seal 5 is attached in the direction of rotation of the first developing roller 3A. Thus, a gap GP3 between the downstream bulge 142 and the first developing roller 3A is narrower than the GP1 between the opening peripheral part 141 and the first developing roller 3A.

The first end 6E1 of the third entrance seal 6 is attached, via double-sided adhesive tape or the like, to the inner wall of the opening peripheral part 141, and thus the gap between the third entrance seal 6 and the first developing roller 3A is almost determined. However, when the gap between the third entrance seal 6 and the first developing roller 3A is too wide, it is possible that toner accumulates in the gap and drops therefrom.

The drop of toner can be inhibited by reducing the accumulation of toner. When the end of the magnetic brush on the first developing roller 3A contacts the face of the third entrance seal 6, the end of the magnetic brush scrapes the toner adhering to the face of the third entrance seal 6 facing the first developing roller 3A. The height of the magnetic brush, however, decreases as the amount of developer scooped onto the first developing roller 3A decreases over time. Then, the magnetic brush has a reduced capability to scrape off toner from the third entrance seal 6.

Toner accumulates on the third entrance seal 6 in a range where the magnetic brush has the reduced capability to scrape off toner, and the toner drops to the first developing roller 3A upon vibration or the like. Accordingly, even in a developing device in which the drop of toner is inhibited at an early stage of use, the capability to scrape off toner gradually decreases, resulting in the drop of toner, as the amount of developer scooped onto decreases over time. In particular, since the free second end 6E2 of the third entrance seal 6 is close to the photoconductor 1, the accumulation of toner on the free second end 6E2 or an adjacent area directly relates to the drop of toner.

If the gap between the third entrance seal 6 and the first developing roller 3A is too narrow, developer fails to pass through the gap.

By contrast, the capability to scrape off toner can be enhanced by reducing the gap GP1 to the gap GP3 downstream from the attachment range 141*b* of the opening peripheral part 141 to which the second entrance seal 5 is attached, as illustrated in FIG. 8.

That is, with the downstream bulge 142, the second entrance seal 5 approaches the first developing roller 3A. Since the distance between the second entrance seal 5 and the third entrance seal 6 is reduced, the third entrance seal 6 approaches the first developing roller 3A due to the contact of the second entrance seal 5. Accordingly, even when the amount of developer scooped onto the first developing roller 3A decreases, the tip of the magnetic brush can contacts the face of the third entrance seal 6 facing the toner carried on the first developing roller 3A, thereby enhancing the capability of the magnetic brush to scrape off toner. Thus, the drop of toner is inhibited for a long time.

It is preferable that the gap GP3 is smaller by about 0.2 mm to 0.5 mm than the gap GP1, and the gap GP2 is equal to or greater than about 1.0 mm. If the gap GP3 is extremely narrow, the developer on the first developing roller 3A is blocked and does not pass through the clearance between the first developing roller 3A and the third entrance seal 6. Then, the developer accumulates in the narrow gap GP3.

It is preferable that the reduced gap GP3 is about 1 mm to 5 mm in the direction of rotation of the first developing roller 3A.

It is to be noted that the downstream bulge 142 illustrated in FIG. 8 can be molded together with opening peripheral part 141, as a single piece, or a separate component attached to the opening peripheral part 141. For example, a separate resin component is attached to the opening peripheral part 141 of the development casing 14 using double-sided adhesive tape, glue, or the like.

Attaching the separate component to the opening peripheral part 141 is advantageous in that a mold shape to form the development casing 14 is simplified, thereby reducing the cost. Additionally, attaching the separate component facilitates change of position to which the second entrance seal 5 is secured.

It is to be noted that, although the description above concerns the multistage developing device including two developer bearers, the configuration to attain the effects described above are not limited thereto. The above-described aspects of this pacification can adapt to developing devices including a single developer bearer as well as developing devices including three or more developer bearers.

Additionally, the aspects of the present specification can adapt to, not limited to multicolor laser copiers, various types of image forming apparatuses, such as single-color laser printers and single-color copiers. Although the image forming apparatus 500 illustrated in FIG. 1 employs an intermediate transfer method, a direct transfer method may be employed. In the direct transfer method, toner images are transferred from multiple photoconductors and superimposed one on another on a sheet (i.e., a recording medium) carried on a conveyor such as a conveyor belt disposed facing the multiple photoconductors.

The various aspects of the present specification can attain specific effects as follows.

Aspect A

A developing device that includes a developer bearer, such as the first developing roller 3A, disposed facing a latent image bearer, such as the photoconductor 1, and configured to carry, by rotation, developer including toner to a developing range facing the latent image bearer to supply the toner to a latent image on the developer bearer; a developer regulator, such as the doctor blade 13, disposed facing the developer bearer across a regulation gap to adjust an amount of developer carried on the developer bearer; a casing, such as the opening peripheral part 141 of the development casing 14, to face at least a part of a surface of the developer bearer upstream from the developing range in a direction of rotation of the developer bearer; a first seal, such as the first entrance seal 4, having a first end (4E1) secured to the casing and a second end (4E2) to contact the surface of the latent image bearer at a position upstream from the developing range in a direction of rotation of the latent image bearer; a second seal, such as the second entrance seal 5, having a first end (5E1) secured to an opposing face of the casing opposing the developer bearer and a second end (5E2) to contact the first seal at a position upstream from the developing range in the direction of rotation of the developer bearer; and a third seal, such as the third entrance seal 6, having a first end (6E1) secured to the opposing face of the casing (e.g., the opening peripheral part 141) and a second end (6E2) disposed to sag under the gravity at a position upstream from the developing range in the direction of rotation of the developer bearer so that the second end of the third seal contacts the developer on the developer bearer that has passed through the position where the developer regulator adjusts the amount of the developer.

According to Aspect A, the first entrance seal 4 closes the clearance between the opening peripheral part 141 of the development casing 14 and the surface of the photoconductor 1. Accordingly, the first entrance seal 4 inhibits scattering, to outside the development casing 14, of the developer that has passed through the regulation position facing the doctor blade 13. Additionally, the second entrance seal 5 contacts the first entrance seal 4, thereby assisting the first entrance seal 4 to contact the surface of the photoconductor 1. Accordingly, the first entrance seal 4 better inhibits scattering of toner to the outside of the development casing 14.

Additionally, the tip of the magnetic brush of developer carried by the first developing roller 3A rubs on the face of the third entrance seal 6 facing the first developing roller 3A. Then, the developer is inhibited from accumulating on the third entrance seal 6, thereby inhibiting inconveniences caused by the drop of aggregated toner from the third entrance seal 6.

Additionally, the third entrance seal 6 that contacts the developer on the first developing roller 3A is not taut but drapes under its own weight. Accordingly, the stress on the developer caused by the contact between the third entrance seal 6 and the developer is reduced or eliminated regardless of whether the developer stands on end (into the magnetic brush) or lies on the first developing roller 3A. Compared with a case where both ends of the entrance seal are secured, unevenness in the developer conveyed can be reduced.

Further, letting the second end 6E2 of the third entrance seal 6 sag under the gravity makes the placement of the third entrance seal 6 easier compared with a case where the second end 6E2 of the third entrance seal 6 is kept in contact with an end of another seal to secure the third entrance seal 6 in the developing device 2.

Aspect B

In Aspect A, the second end of the second seal (e.g., the second entrance seal 5), which contacts the first seal (e.g., the first entrance seal 4) is disposed so that the second seal contacts the third seal when the developing device is set in position to develop the latent image on the latent image bearer (e.g., the photoconductor 1).

According to Aspect B, the third entrance seal 6 is pushed to the first developing roller 3A more reliably. Additionally, the tip of the magnetic brush of developer on the first developing roller 3A reliably rubs on the face of the third entrance seal 6 facing the first developing roller 3A. Then, the developer is inhibited from accumulating on the third entrance seal 6.

Aspect C

In Aspect A or B, the casing (e.g., the opening peripheral part 141), which faces the developer bearer via the second seal (e.g., the second entrance seal 5) and the third seal (e.g., the third entrance seal 6), is shaped to reduce a gap between the casing and the developer bearer partly (e.g., to the gap GP2) in the direction of rotation of the developer bearer.

According to Aspect C, the gap GP1 between the first developing roller 3A and the opening peripheral part 141 is reduced to the gap GP2 (between the bulge 1411 and the first developing roller 3A) in the range where the magnetic brush lies down, and thus the amount by which the third entrance seal 6 moves away from the first developing roller 3A is restricted in that range. This restriction is advantageous in inhibiting the part of the third entrance seal 6 facing the lying developer bristles from being pushed up by the magnetic brush upstream and downstream from the lying developer bristles, thereby securing the chance of rubbing off toner from the third entrance seal 6.

Accordingly, for example, as illustrated in FIG. 7B, the range of the adhesion range R1 is smaller (in the direction of rotation of the first developing roller 3A), and the thickness of the adhesion range R1 is smaller than those in FIG. 7A.

Therefore, while reducing the adhesion range R1 on the third entrance seal 6 facing the lying developer bristles, the amount of accumulation is reduced, and drop of toner aggregations to the first developing roller 3A upon vibration or the like is inhibited. Even if toner drops, the toner aggregations are smaller in size and thickness, thereby alleviating the inconveniences caused by the drop, compared with the configuration in which the gap GP1 between the opening peripheral part 141Z and the first developing roller 3A is uniform.

Aspect D

In Aspect C, the casing (e.g., the opening peripheral part 141) is shaped to reduce the gap between the casing and the developer bearer partly by attaching, to the casing, a gap adjuster to adjust the gap.

Aspect D can attain a similar effect to the effect attained by the bulge 1411 molded as a single piece together with the opening peripheral part 141. Attaching the separate component to the opening peripheral part 141 is advantageous in that a mold shape to form the development casing 14 is simplified, thereby reducing the cost. Additionally, attaching the separate component facilitates position change of the magnetic poles of the first developing roller 3A or the like.

Aspect E

In any one of Aspects A through D, in a range where the casing (e.g., the opening peripheral part 141) faces the developer bearer via the second seal (e.g., the second entrance seal 5) and the third seal (e.g., the third entrance seal 6), the gap between the casing and the developer bearer is reduced (to the gap GP3) in portion downstream, in the direction of rotation of the developer bearer, from the attachment range (e.g., the attachment range 141*b*) to which the second seal is secured.

According to Aspect E, the gap between the opening peripheral part 141 and the first developing roller 3A is reduced to the gap GP3 in the portion downstream from the attachment range 141*b* in the direction of rotation of the first developing roller 3A. Thus, the second entrance seal 5 is closer to the first developing roller 3A in the downstream portion.

Then, the distance between the second entrance seal 5 and the third entrance seal 6 is reduced, the third entrance seal 6 is made closer to the first developing roller 3A due to the contact of the second entrance seal 5. Accordingly, even when the amount of developer scooped onto the first developing roller 3A decreases, the tip of the magnetic brush can contacts the face of the third entrance seal 6 facing the toner carried on the first developing roller 3A, thereby enhancing the capability of the magnetic brush to scrape off toner. Thus, the drop of toner is inhibited for a long time.

Aspect F

In Aspect E, the gap between the casing (e.g., the opening peripheral part 141 of the development casing 14) and the developer bearer is partly reduced in the downstream portion by attaching, to the casing, a gap adjuster to adjust the gap.

Attaching the separate component to the opening peripheral part 141 is advantageous in that a mold shape to form the development casing 14 is simplified, thereby reducing the cost. Additionally, attaching the separate component facilitates change of position to which the second entrance seal 5 is secured.

Aspect G

In any one of Aspects A through F, the developing device includes multiple developer bearers such as the first developing roller 3A and the second developing roller 3B.

Use of a multistage developing device, which includes multiple developer bearers, is advantageous in that the number of times the latent image on the latent image bearer is developed increases, and the developing capability increases compared with a single-stage developing device including only one developing roller. Although the developing capability tends to decrease as the rotation speed of the latent image bearer increases to increase the image formation speed, such a decrease can be supplemented in the multistage developing device.

Aspect H

In a process cartridge (e.g., the image forming unit 20) that includes at least the latent image bearer (e.g., the photoconductor 1) and a developing device to develop the latent image on the latent image bearer with toner, the developing device according to any one of Aspects A through G is used.

Aspect I

In an image forming apparatus that includes at least the latent image bearer (e.g., the photoconductor 1) and a developing device to develop the latent image on the latent image bearer with toner, the developing device according to any one of Aspects A through G is used.

Aspect J

In an image forming apparatus that includes a process cartridge including a latent image bearer and a developing device, the process cartridge according to Aspect H is used.

Numerous additional modifications and variations are possible in light of the above teachings. It is therefore to be understood that, within the scope of the appended claims, the disclosure of this patent specification may be practiced otherwise than as specifically described herein.

What is claimed is:

1. A developing device comprising:

a developer bearer disposed facing a latent image bearer to carry, by rotation, developer including toner to a developing range facing the latent image bearer and supply the toner to a latent image on the latent image bearer;

a developer regulator disposed facing the developer bearer to adjust an amount of the developer on the developer bearer;

a casing including an opposing face opposed to a surface of the developer bearer upstream from the developing range in a direction of rotation of the developer bearer;

a first seal including a first end secured to the casing, and a second end to contact a surface of the latent image bearer at a position upstream from the developing range in a direction of rotation of the latent image bearer;

a second seal including a first end secured to an attachment range of the opposing face of the casing, and a second end to contact the first seal at a position upstream from the developing range in the direction of rotation of the developer bearer; and a third seal including a first end secured to the opposing face of the casing, and a second end to contact the developer on the developer bearer at a position downstream from the developer regulator and upstream from the developing range in the direction of rotation of the developer bearer.

2. The developing device according to claim 1, wherein the first end of the third seal is secured to the opposing face of the casing at a position upstream from the attachment range in the direction of rotation of the developer bearer.

3. The developing device according to claim 1, wherein the second end of the third seal sags under a force of gravity.

4. The developing device according to claim 1, wherein the second end of the second seal, which contacts the first seal, is disposed such that the second seal contacts the third seal in a state in which the developing device is set in position to develop the latent image on the latent image bearer.

5. The developing device according to claim 1, wherein a space between the casing and the developer bearer includes a gap which has a smaller size relative to other portions of the space between the casing and the developer bearer.

6. The developing device according to claim 5, further comprising a gap adjuster attached to the casing to adjust the gap between the casing and the developer bearer.

7. The developing device according to claim 5, wherein the opposing face of the casing comprises a bulge to reduce the gap between the casing and the developer bearer.

8. The developing device according to claim 1, wherein, in a range in which the casing faces the developer bearer via the second seal and the third seal, a gap between the casing and the developer bearer is reduced in a downstream portion downstream, in the direction of rotation of the developer bearer, from the attachment range to which the first end of the second seal is secured.

9. The developing device according to claim 8, further comprising a gap adjuster attached to the casing to adjust the gap between the casing and the developer bearer, the gap adjuster disposed downstream from the attachment range in the direction of rotation of the developer bearer.

10. The developing device according to claim 8, wherein the opposing face of the casing comprises a downstream bulge to reduce the gap between the casing and the developer bearer, the downstream bulge disposed downstream from the attachment range in the direction of rotation of the developer bearer.

11. The developing device according to claim 1, further comprising another developer bearer disposed facing the latent image bearer.

12. A process cartridge to be removably installed in an image forming apparatus, the process cartridge comprising:

the latent image bearer; and the developing device according to claim 1 to supply the toner to the latent image on the latent image bearer.

13. An image forming apparatus comprising the process cartridge according to claim 12.

14. An image forming apparatus comprising:

the latent image bearer; and the developing device according to claim 1 to supply the toner to the latent image on the latent image bearer.

* * * * *